United States Patent [19]

Antieri et al.

[11] 4,381,986

[45] May 3, 1983

[54] COOLING AND SOLIDIFICATION OF HEAVY HYDROCARBON LIQUID STREAMS

[75] Inventors: Salvatore J. Antieri, Trenton, N.J.; Alfred G. Comolli, Yardley, Pa.

[73] Assignee: Hydrocarbon Research, Inc., Lawrenceville, NJ

[21] Appl. No.: 286,930

[22] Filed: Jul. 27, 1981

[51] Int. Cl.[3] ..... C10C 3/16

[52] U.S. Cl. ..... 208/8 R; 208/39

[58] Field of Search ..... 208/8 R, 39; 264/13, 264/14; 425/6

[56] References Cited

U.S. PATENT DOCUMENTS

| | | | |
|---|---|---|---|
| 2,878,650 | 3/1959 | Krchma | 208/39 X |
| 3,042,970 | 7/1962 | Terenzi | 264/14 |
| 3,434,967 | 3/1969 | Oldenburg | 264/14 |
| 3,457,335 | 7/1969 | Elliott | 264/13 |
| 4,021,328 | 5/1977 | Wolk | 208/39 |
| 4,149,837 | 4/1979 | Baker et al. | 264/14 X |

*Primary Examiner*—Delbert E. Gantz
*Assistant Examiner*—Glenn A. Caldarola
*Attorney, Agent, or Firm*—V. A. Mallare; F. A. Wilson

[57] ABSTRACT

A process and apparatus for cooling and solidifying a stream of heavy hydrocarbon material normally boiling above about 850° F., such as vacuum bottoms material from a coal liquefaction process. The hydrocarbon stream is dropped into a liquid bath, preferably water, which contains a screw conveyor device and the stream is rapidly cooled, solidified and broken therein to form discrete elongated particles. The solid extrudates or prills are then dried separately to remove substantially all surface moisture, and passed to further usage.

7 Claims, 2 Drawing Figures

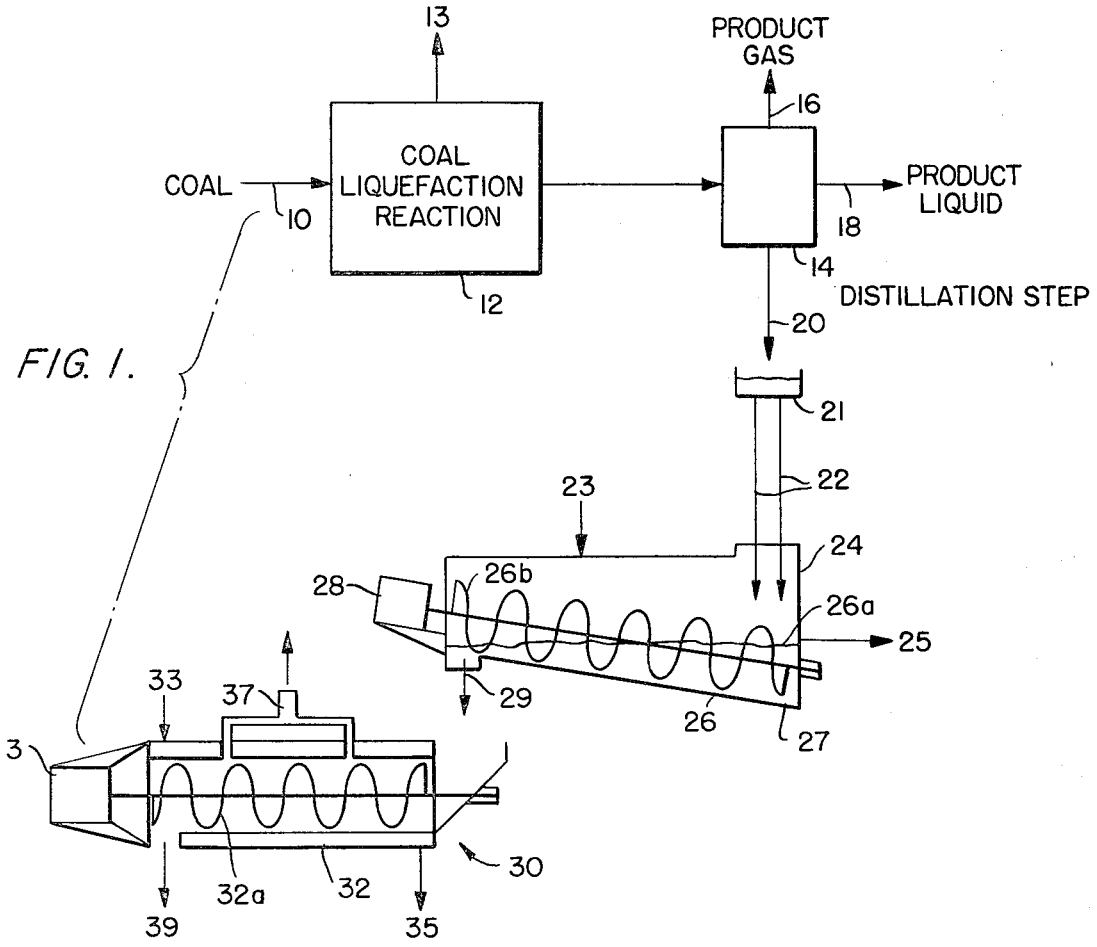
FIG. 1.
FIG. 2.
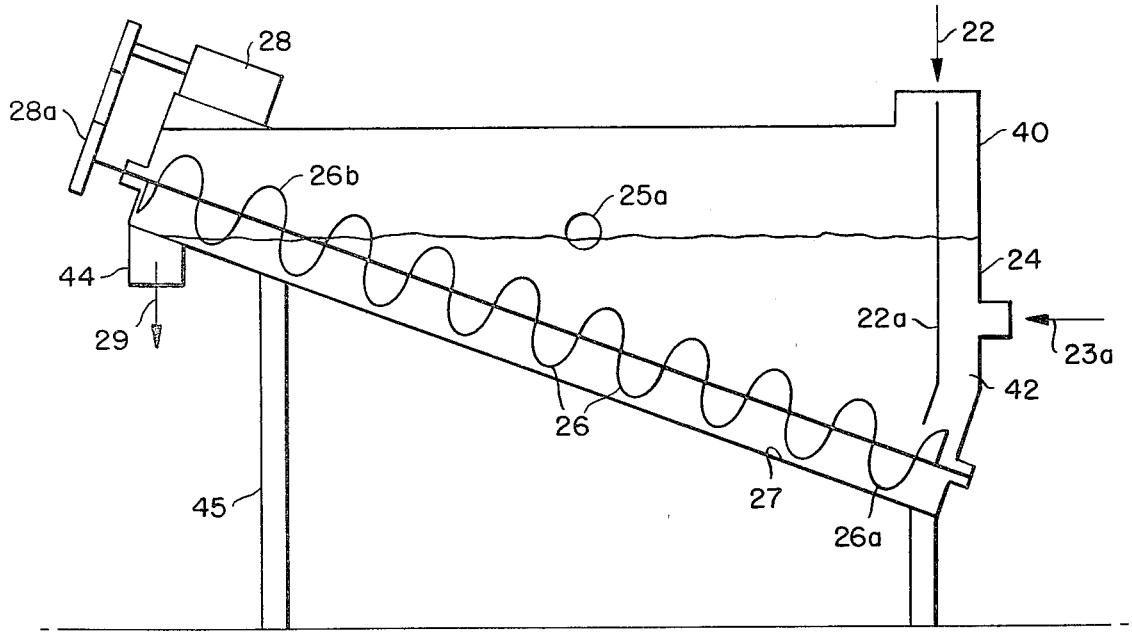

COOLING AND SOLIDIFICATION OF HEAVY HYDROCARBON LIQUID STREAMS

BACKGROUND OF THE INVENTION

This invention pertains to a process and apparatus for cooling and solidification of heavy hydrocarbon liquid streams boiling above about 850° F., and particularly to the solidification of vacuum bottoms material stream withdrawn from a coal liquefaction process to form discrete solid particles.

At the present time, the vacuum bottoms material stream derived from coal liquefaction process and having a normal boiling temperature above about 850° F. is cooled and flaked on a moving metal belt prior to further use or disposal. Although this hydrocarbon cooling arrangement has been found useful, it has some disadvantages, such as it requires excessive space and produces a brittle product of varying size having sharp edges. Such material is difficult to handle in bulk handling systems and is generally undesirable. Consequently, a more suitable process for rapidly cooling and solidifying such heavy hydrocarbon material streams to form a more uniform sized and desirable product and which requires less space has been sought.

SUMMARY OF THE INVENTION

This invention provides a process and apparatus for cooling and solidifying heavy hydrocarbon liquid material streams normally boiling above about 850° F. temperature, to produce solid discrete particules. The heavy hydrocarbon liquid stream is withdrawn from a conversion process, which is preferably a coal liquefaction process, at temperature usually within the range of 350°–650° F., and is passed into a liquid bath for rapid cooling and solidification therein. The liquid bath temperature is maintained within a temperature range of 50°–150° F., and preferably 80°–120° F. temperature, preferably by circulating the liquid from an external source. Cooling liquids useful for this invention include water, water-glycol solutions, and light hydrocarbon liquids having boiling range of 250°–400° F., with water being preferred.

Following such initial cooling and solidification of the hydrocarbon liquid stream, the solid hydrocarbon material is passed on through the liquid bath by suitable conveyor means, which is preferably a rotary screw conveyor device. In the conveyor the elongated extrudate hydrocarbon material initially formed is broken into shorter pieces, and forms solid extrudates or prills which may be slightly curved. These prills are somewhat flexible, porous and if cooled in water usually contain between 5 and 15 W % combined moisture. These prills can preferably be further dried in a separate drying step to substantially remove surface moisture and to reduce their moisture content to 1 to 8 W %. Such drying step can be advantageously provided by conveying the particles past a hot curved wall heated by steam or other available fluid, or by electric heating means.

Although the cooling process and apparatus of this invention is preferably used for treating the vacuum distillation bottoms streams containing 40–60 W % ash solids withdrawn from a catalytic coal liquefaction process, such as the H-Coal TM Process, it is also useful for treating heavy hydrocarbon streams from other coal liquefaction processes, and from petroleum refining processes.

DESCRIPTION OF THE DRAWINGS

FIG. 1 is a schematic diagram showing the essential process steps of the invention.

FIG. 2 is a cross-sectional view of a typical water-cooled screw conveyor device used in the process.

DESCRIPTION OF THE PREFERRED EMBODIMENTS

As shown in FIG. 1, coal at 10 is fed to a liquefaction step 12, and the resulting fluid is passed to a distillation step 14 from which gas and light liquid products are withdrawn. A heavy hydrocarbon material stream at 20, such as a vacuum bottoms material normally boiling between about 850° and 1100° F., is withdrawn usually from a vacuum distillation step included in 14 as viscous liquid stream 20 containing 40–60 W % total solids. A typical coal liquefaction process vacuum distillation step is disclosed in U.S. Pat. No. 4,045,329 to Johanson, et al, the disclosure of which is incorporated herein by reference. Temperature of the liquid stream 20 will usually be in the range of 350°–650° F., and is preferably 400°–600° F. The hydrocarbon stream is usually dropped through ambient air into water tank 24 for rapidly cooling and solidifying the stream. If desired, multiple streams 22 produced by passing through an orifice plate at 21 can be used, particularly for large capacity processes, and will usually have stream diameter within the range of 0.06–0.60 inch.

In water tank 24, the hydrocarbon liquid stream(s) 22 is rapidly cooled at a rate exceeding about 500° F. per minute to a temperature below its solidification temperature which is usually about 250°–275° F. The cooling water enters the tank at 23 and is removed at 25, but may flow cocurrently relative to the hydrocarbon material. An elongated solid hydrocarbon extrudate **22*a* is initially formed in the liquid and is passed into the inlet 26*a* of rotating screw conveyor 26 driven by motor 28. The axis of screw conveyor 26 is inclined upwardly at an angle with the horizontal plane and the water exit connection is located at a level such that the water cooling bath does not reach the conveyor exit end 26*b*, and the particles are removed at 29 without overflow of any water. The cooling water depth above the screw 26 should be at least about 6 inches for adequate cooling, as is preferably 8–18 inches. The clearance between outer diameter of screw 26 and the lower wall 27 of tank 24 is not critical and is usually 0.030–0.250 inch. Because of the rotating screw conveyor 26** some tumbling action for the extrudates is produced, which further serves to break up the longer extrudates into shorter pieces. In general, the longer the material remains in the rotating screw, the more tumbling action occurs and the shorter the pieces will be. The hydrocarbon material residence time is usually 2–4 minutes.

As a result of the stream rapid cooling, solidification, and breaking action in the rotating screw conveyor 26, the hydrocarbon material forms short extrudate-shaped pieces called prills, which are removed at 29. These prills are somewhat flexible and porous, and usually have moisture content within the range of 5–15 W %. Typical size prills will be slightly curved and be about 0.10 inch diameter by 0.500 inch long. If desired, the cooling liquid can comprise a water solution or a hydrocarbon liquid having normal boiling range of about 250°–450° F.

The hydrocarbon prills are preferably next passed to a separate drying step 30. Here the prills are heated to 150°–250° F. and dried to remove substantially all surface moisture by passing prills from 29 into the inlet end of screw conveyor 31, which moves them past heated inner wall 32*a* of cylindrical jacket 32. A hot fluid, preferably stream, is introduced at 33 into jacket 32 and removed at 35. Vapor from the drying prills is collected and vented from the dryer through conduit 37. The prills, which are substantially free of surface moisture and now have their moisture content reduced to 1–8 W %, are withdrawn at 39 for further use, such as for fuel, a feed material for hydrogen production, or for disposal as a non-leachable material. If desired, such hydrocarbon prills derived from coal liquefaction process can be gasified and used to produce the hydrogen needed in the coal hydrogenation process.

A more detailed cross-sectional view of the hydrocarbon stream cooling and solidification apparatus is provided by FIG. 2. One or more hydrocarbon streams 22 are dropped through opening 40 into tank 24 containing water bath 42. Screw conveyor 26, which is driven at rotational speed of 20–40 rpm by suitable drive means 28, is partly immersed in the bath 42, which is maintained at the level of the screw conveyor outlet 44 by the location of water outlet connection 25*a*. As disclosed, the hydrocarbon liquid stream 22 is rapidly cooled and solidified to form an elongated extrudate 22*a*, which is broken into short pieces by rotating screw 26. Also, tumbling action of the hydrocarbon extrudate pieces in the rotating screw serves to further break them into shorter pieces. The stream 29 of solid prills is removed thorugh opening 44 and is usually passed to a separate drying step for further removal of moisture.

This invention will be further illustrated by reference to the following example, which should not be construed as limiting in scope.

EXAMPLE 1

A heavy hydrocarbon bottoms stream was withdrawn at 600° F. temperature from a vacuum distillation step of a prototype coal liquefaction process at flow rate of about 100 pound/hour. The vacuum bottoms material stream, having diameter varying between about 0.060–0.130 inch, was dropped by gravity feed through air into a water tank having an upwardly inclined rotating screw conveyor mounted therein. Inspections made on the vacuum bottoms material are provided in Table 1.

The heavy hydrocarbon stream was dropped through about 8 inch water depth and cooled quickly from about 600° F. to below its solidification temperature of about 275° F. to form an elongated solid extrudate. This extrudate was then passed through a screw conveyor having about 6 inch blade pitch and rotating at about 30 rpm. The clearance between the screw and the bottom of the inner wall was about 0.065 inch. The solidified hydrocarbon material was broken into shorter pieces by the rotating screw and tumbling action to form extrudates or prills having dimensions of about 0.06–0.130 inch diameter by 0.50 inch long. The prills were withdrawn and placed into bags for further handling and use.

Although the invention has been described with reference to certain preferred embodiments, it will be understood that modifications and variations in the configurations described can be made within the spirit and scope of the invention, which is defined by the following claims.

TABLE 1

Properties of Vacuum Bottoms Stream From Coal Liquefaction Process

| | |
|---|---|
| Normal Boiling Range, °F. | 800° to 975° F. + |
| Sulfur, W % | 1.0–1.1 |
| Toluene solubles, W % | 41–43.3 |
| Toluene insolubles, W % | 27–27.2 |
| Ash, W % | 28.9–31 |
| Total Solids, W % | 44–46 |

We claim:

1. A process for cooling and solidifying heavy hydrocarbon liquid materials to provide discrete solid particles, comprising:

(a) introducing a stream of the hydrocarbon material at a temperature within the range of 350°–650° F. from a coal liquefaction process into a liquid bath maintained within the range of 50–150° F. and cooling said material in the bath to below its solidification temperature to form an elongated solid extrudate;

(b) passing the solidified material through the liquid bath for further cooling and mechanical breaking to form discrete particles therein; and (c) withdrawing the hydrocarbon material particles from the cooling liquid bath.

2. The process of claim 1, wherein the cooled material is passed through the liquid cooling bath by a rotary screw conveyor having its inlet end submerged in the liquid, and said conveyor mechanically breaks the elongated solids into shorter pieces.

3. A process for cooling and solidifying heavy hydrocarbon liquid materials to provide discrete solid particles, comprising:

(a) introducing a stream of the hydrocarbon material at temperature within the range of 350°–650° F. into a water bath and rapidly cooling said material therein to below its solidification temperature to form an elongated extrudate solid;

(b) passing the solid material into the inlet end of a rotating screw conveyor having its inlet end submerged in the water for further cooling, and mechanically breaking said material to form discrete particles therein; and (c) withdrawing the hydrocarbon material particles having diameter of 0.060 to 0.600 inch from the conveyor exit end.

4. A process for cooling and solidifying heavy hydrocarbon liquid materials to provide discrete solid particles, comprising:

(a) introducing a stream of the hydrocarbon material at temperature of 350°–650° F. into a water bath and rapidly cooling said material therein to below its solidification temperature to form an elongated extrudate solid;

(b) passing the solid material into the inlet end of a rotating screw conveyor submerged in the water for further cooling and breaking the elongated extrudate to form discrete particles therein;

(c) withdrawing the hydrocarbon material particles from the screw conveyor exit end passing them through a drying step to substantially remove surface moisture; and (d) withdrawing the dried hydrocarbon particles.

5. A coal liquefaction process wherein coal is fed into a reaction zone maintained at elevated temperature and pressure conditions and gaseous and light hydrocarbon liquid products are withdrawn along with a heavy hydrocarbon stream containing ash, wherein the improvement comprises:

(a) passing at least one heavy hydrocarbon stream into a liquid cooling bath and rapidly cooling the hydrocarbon material in the bath to below its solidification temperature and forming elongated solid extrudate in the liquid;

(b) breaking the extrudate into shorter pieces while continuing their cooling; and (c) withdrawing the solid particulate hydrocarbon material from the cooling bath.

6. The process of claim 5, wherein the liquid cooling bath contains water and the hydrocarbon material cooling rate exceeds about 500° F. per minute.

7. The process of claim 5, wherein the liquid cooling bath contains a light hydrocarbon liquid having normal boiling range of 300°–500° F. produced in the coal liquefaction process.

* * * * *